United States Patent [19]

Bauder

[11] Patent Number: 4,683,850

[45] Date of Patent: Aug. 4, 1987

[54] OIL SUMPS FOR INTERNAL COMBUSTION ENGINES

[75] Inventor: Armin Bauder, Neckarsulm, Fed. Rep. of Germany

[73] Assignee: Audi AG, Ingolstadt, Fed. Rep. of Germany

[21] Appl. No.: 888,761

[22] Filed: Jul. 22, 1986

[30] Foreign Application Priority Data

Sep. 3, 1985 [DE] Fed. Rep. of Germany ..... 3531352

[51] Int. Cl.[4] ..... F02F 7/00

[52] U.S. Cl. ..... 123/195 C; 123/196 R; 123/198 E; 184/106

[58] Field of Search ..... 123/196 R, 195 C, 198 E; 184/106

[56] References Cited

U.S. PATENT DOCUMENTS

| | | | |
|---|---|---|---|
| 730,738 | 6/1903 | Brush | 123/196 R |
| 1,200,172 | 10/1916 | Danver | 184/106 |
| 1,566,438 | 12/1925 | Smith | 184/106 |
| 1,892,185 | 12/1932 | Clements | 184/106 |
| 2,833,163 | 5/1958 | Trombley | 123/195 C |
| 4,270,497 | 6/1981 | Valerio | 184/106 |
| 4,296,716 | 10/1981 | Hofbauer et al. | 123/195 C |
| 4,392,552 | 7/1983 | Partridge | 184/106 |

FOREIGN PATENT DOCUMENTS

| | | | |
|---|---|---|---|
| 1919040 | 7/1977 | Fed. Rep. of Germany | 184/106 |

*Primary Examiner*—E. Rollins Cross

*Attorney, Agent, or Firm*—Kane, Dalsimer, Kane, Sullivan and Kurucz

[57] ABSTRACT

An oil sump 1 of an internal combustion engine has a recess 3, into which dips a suction funel 5 of an oil pump. The funnel is spaced slightly from the oil sump floor 7. A honeycomb-shaped insert 8 is positioned in the recess 3 at a slight spacing from the oil sump floor 7. The height b of the insert 8 amounts to a multiple of the spacing a from the oil sump floor and also a multiple of the side length c of the substantially square cross-section of the chambers 11 of the insert 8. As a result, the oil flowing back from the engine, which is strongly foamed with air because of the rotating motion of the crankshaft drive, can become de-foamed in the relatively high chambers 11, whereby the oil foam in the chambers 11 rises and air-free oil in the chambers drops down to the oil sump floor 7. This ensures that the oil pump, which is pumping out from the oil sump floor 7, essentially draws in air-free oil.

5 Claims, 2 Drawing Figures

OIL SUMPS FOR INTERNAL COMBUSTION ENGINES

Figure 1:
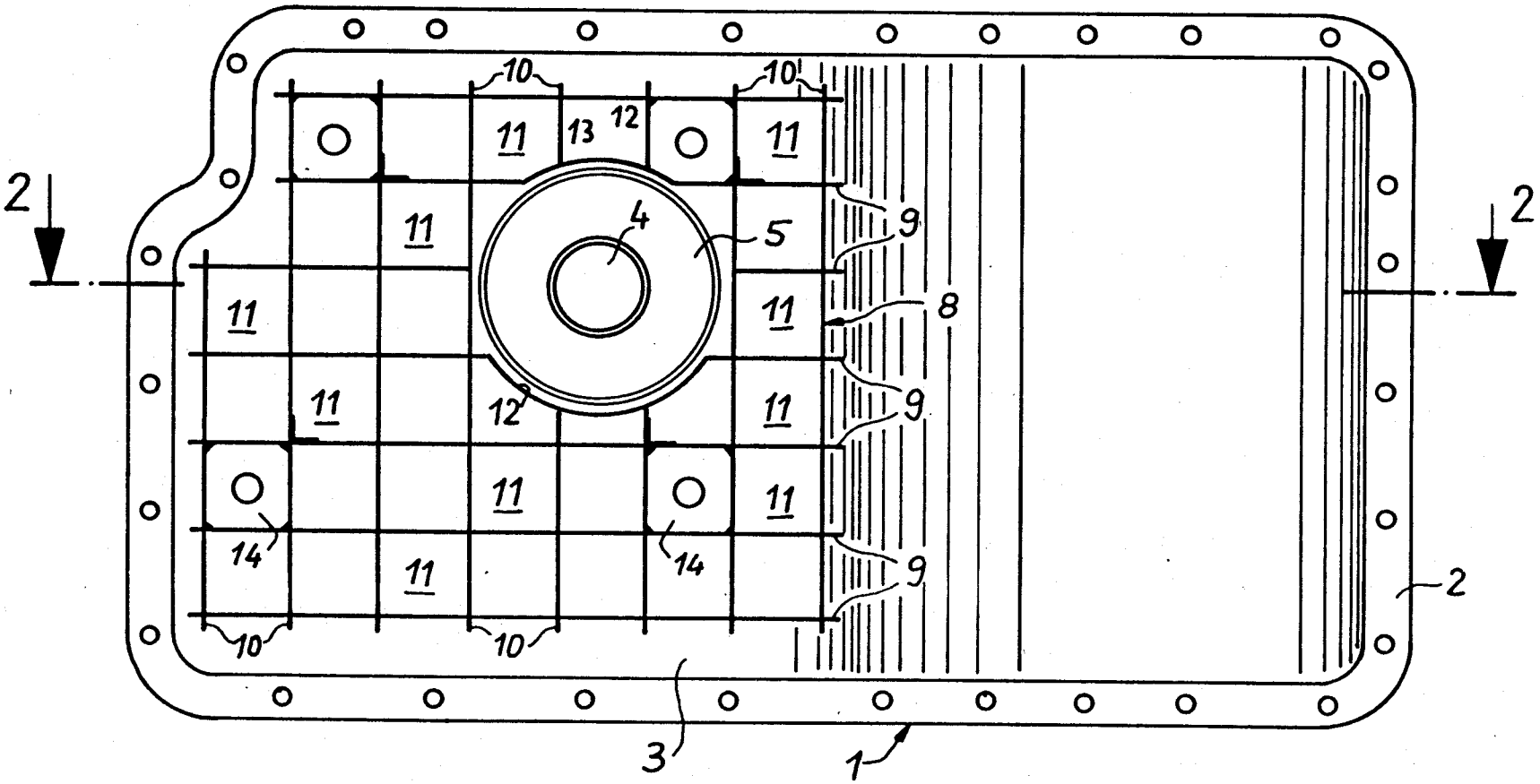

The invention relates to an oil sump for an internal combustion engine, defining a recess into which dips a suction pipe of an oil pump, which pipe opens at a sliqht spacing from the floor of the oil sump.

For a generally conventional construction of the oil sump, it is best for the shape to be as flat as possible, in order to keep the overall height of the engine as small as possible and to enable it to be incorporated in as low as possible a position, so that a low centre of gravity of the vehicle is obtained and an aerodynamically favourable construction of the bodywork can be achieved. Flat oil sumps naturally have a relatively small volume, and this leads to difficulties if oil pumps with a high discharge capacity, for example, 100 l/min. and over, have to be provided for an adequate supply of the bearings of the engine with lubricating oil. This is because a circulating movement of air is created in the crankcase and in the oil sump which is flange-mounted thereto, by the rotating crankshaft drive. This air movement forces the oil in the sump upwards at the sides and draws it away from the suction pipe of the oil pump. Moreover, because of the running of the engine, foaming of the oil is caused, so that the oil pump frequently does not draw in pure oil, but an aerosol of oil and air. With a proportion of air in excess of approximately 15% proper lubrication of the bearings is no longer ensured.

It is an object of this invention to provide an oil sump which ensures that essentially only non-foamed oil is drawn in.

Accordingly this invention provides an oil sump for an internal combustion engine, defining a recess into which dips a suction pipe of an oil pump so as to open at a slight spacing from the floor of the oil sump, and incorporating a honeycomb-shaped insert, which is positioned in the recess at a slight spacing from the floor of the oil sump and whose height amounts to a multiple of its spacing from the oil sump floor, and which has a passageway for the suction pipe of the oil pump.

With this arrangement according to the invention the oil foam in the individual chambers of the honeycomb-shaped insert rises upwards, whilst air-free oil drops downwards to the floor of the oil sump, where it is drawn off by the oil pump. The honeycomb-shaped insert prevents the circulating air flow on the floor of the oil sump having any effect.

The honeycomb-shaped insert also avoids the drawing away of the oil from the suction pipe of the oil pump, when a vehicle with an engine which is equipped with the oil sump according to the invention is accelerating, braking and travelling round curves. This is because the oil which is in the individual chambers of the honeycomb-shaped insert flows to the bottom of the oil sump.

The height of the honeycomb-shaped insert can be up to six times the spacing of the insert from the oil sump floor. As a result of this, non-foamed oil is found at the bottom of the oil sump, and there is sufficient space available in the chambers for the oil foam and sufficient time also remains for the oil to be de-foamed when large quantities of oil are being conveyed.

The chambers of the insert preferably have a roughly square cross-section with the height of the insert amounting to a multiple, for example, three times the side length of the square cross-section. The individual chambers therefore form relatively long passages with a comparable small cross-section, in which a reliable de-foaming of the oil can take place.

The honeycomb-shaped insert preferably extends over the entire floor area of the cavity of the oil sump. It can, however, even continue into the flatter part of the oil sump.

Figure 2:
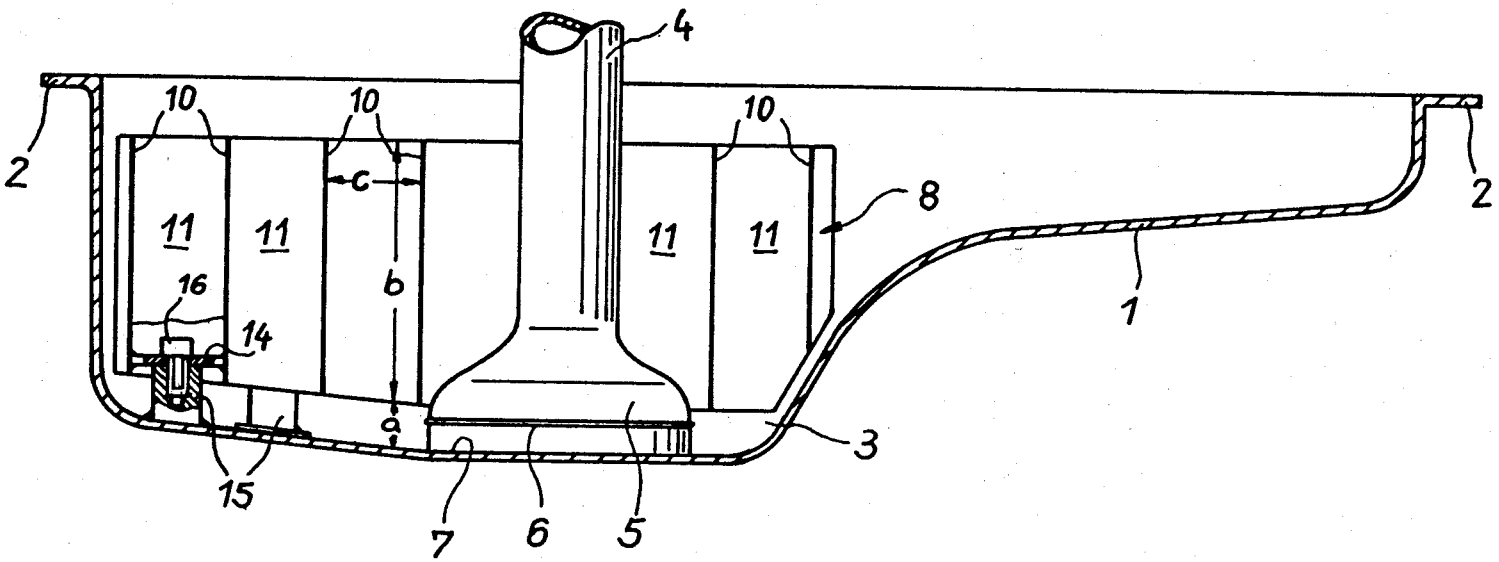

The invention may be performed in various ways and a preferred embodiment thereof will now be described with reference to the accompanying drawings, in which:

FIG. 1 shows a top plan view of an oil sump of the invention with a honeycomb-shaped insert; and FIG. 2 shows a section along the line 2—2 of FIG. 1.

The oil sump 1, which has an encircling flange 2 by which it is screwed onto a crankcase of an engine (not shown), is provided with a recess 3 which collects the oil flowing back from the engine. A suction pipe 4 of an oil pump (not shown) has a suction funnel 5 which dips into the recess 3. The mouth 6 of the suction funnel 5 is situated at a slight spacing from the oil sump floor 7, as can be seen from FIG. 2.

The oil sump 1 contains a honeycomb-shaped insert 8, which substantially extends over the entire floor area of the cavity 3 and is arranged at a slight spacing a from the oil sump floor 7. The insert 8 is composed of perpendicular longitudinal and transverse walls 9 or 10, which define chambers 11 with a mainly square cross-section. The insert 8 is provided with a passage 13 which is defined by partly cylindrical walls 12, and through which extends the suction pipe 4 with its suction funnel 5. The insert 8 in this example rests, via small support plates 14, which are fixed at suitable positions in chambers 11, against extensions 15 which extend upwards from the sump floor 7. Fastening to these extensions 15 is achieved by screws 16. Alternatively, the insert 8 can also be spot-welded to the oil sump floor 7, but at the desired spacing of the insert above the oil sump floor.

The height b of the insert 8 amounts to a multiple of the side length c of the chambers 11. The chambers 11 consequently form relatively high passages with a comparably small cross-section, in which the oil which has been thickly foamed with air by the rotating motion of the crankshaft drive of the engine can become de-foamed. The oil foam in the chambers 11 rises and air-free oil in the chambers 11 drops down to the oil sump floor 7 and is drawn off there by the oil pump. It is also important here that the spacing a of the insert 8 from the oil sump floor 7 is considerably smaller than the height b of the insert 8, as this ensures that the oil pump cannot draw in from a region which contains foaming oil. Moreover, the oil on the oil sump floor 7 is also prevented from being drawn away from the suction point of the suction funnel during acceleration, braking or travelling around curves by the slight spacing a. Naturally, the spacing a must be carefully dimensioned, so that that pump can draw in oil from the floor in an unimpeded way.

By arrangement of the insert 8, air-free oil can be drawn in through the oil pump with success, even with a very flat oil sump whose oil content is strongly subject to the air vortex created by the rotating motion of the crankshaft drive.

I claim:

1. An oil sump for an internal combustion engine, the oil sump defining a recess, a suction pipe of an oil pump dipping into the recess so as to open at a slight spacing from the floor of the oil sump, a honeycomb-shaped insert positioned in the recess at a slight spacing from the floor of the oil sump, the insert having a height which amounts to a multiple of its spacing from the oil sump floor, and a passageway defined in the insert for receipt of the suction pipe of the oil pump.

2. An oil sump as claimed in claim 1, wherein the height of the honeycomb insert is up to six times the spacing of the insert from the oil sump floor.

3. An oil sump as claimed in claim 1, wherein the honeycomb chambers of the insert have a substantially square cross-section and the height of the insert is a multiple of the side length of the square cross-section.

4. An oil sump as claimed in claim 3, wherein the height of the honeycomb insert is up to three times the side length of the square cross-section.

5. An oil sump as claimed in claim 1, wherein the honeycomb-shaped insert extends substantially over the entire floor area of the recess.

* * * * *